US008167288B2

(12) United States Patent
Despins et al.

(10) Patent No.: US 8,167,288 B2
(45) Date of Patent: May 1, 2012

(54) FORCE MULTIPLYING HANDLE MECHANISM FOR A BAR CLAMP

(76) Inventors: Maurice Despins, Edmonton (CA); David Despins, Edmonton (CA)

( * ) Notice: Subject to any disclaimer, the term of this patent is extended or adjusted under 35 U.S.C. 154(b) by 496 days.

(21) Appl. No.: 12/350,679

(22) Filed: Jan. 8, 2009

(65) Prior Publication Data

US 2009/0178507 A1 Jul. 16, 2009

Related U.S. Application Data

(60) Provisional application No. 61/021,179, filed on Jan. 15, 2008.

(51) Int. Cl.
*B25B 5/06* (2006.01)

(52) U.S. Cl. ..... 269/6; 269/3; 29/242; 29/243

(58) Field of Classification Search ..... 254/26 E, 254/21, 25; 269/3, 6, 95; 29/242, 243
See application file for complete search history.

(56) References Cited

U.S. PATENT DOCUMENTS

| | | | | |
|---|---|---|---|---|
| 3,370,881 | A | 2/1968 | Renfroe | |
| 3,964,738 | A | 6/1976 | Owen | |
| 4,498,699 | A | 2/1985 | Davies | |
| 5,245,755 | A | 9/1993 | Krivec | |
| 5,460,461 | A * | 10/1995 | McGrath | 404/118 |
| 5,961,109 | A * | 10/1999 | Dykstra et al. | 269/228 |
| 6,932,335 | B1 * | 8/2005 | Dykstra | 269/228 |
| 7,093,366 | B2 * | 8/2006 | Black | 30/296.1 |
| 7,320,165 | B1 * | 1/2008 | Hard | 29/272 |
| 7,665,718 | B1 * | 2/2010 | Benson | 269/237 |
| 7,673,784 | B2 * | 3/2010 | Headings et al. | 228/44.3 |
| 2009/0178507 | A1 * | 7/2009 | Despins et al. | 74/490.15 |

* cited by examiner

*Primary Examiner* — Lee D Wilson
(74) *Attorney, Agent, or Firm* — Scott T. Griggs; Griggs Bergen LLP

(57) ABSTRACT

A force multiplying handle mechanism for a hand-operated bar clamp having a fixed handle and a movable handle is provided. The mechanism can comprise a pivotal attachment disposed on the end of the fixed handle, a handle having a pivot plate disposed on one end of the handle extending therefrom thereby substantially forming an L-shaped member, the pivot plate pivotally attached to the pivotal attachment and a pin extending substantially perpendicularly from the pivot plate, the pin configured to contact the movable handle. When force is applied to the handle to cause the pivot plate to pivot about the pivot attachment, the pin squeezes the movable handle towards the fixed handle.

20 Claims, 5 Drawing Sheets

FORCE MULTIPLYING HANDLE MECHANISM FOR A BAR CLAMP

PRIORITY STATEMENT & CROSS-REFERENCE TO RELATED APPLICATIONS

This application claims priority from U.S. Patent Application No. 61/021,179, entitled "Force Multiplying Handle Mechanism For a Bar Clamp" and filed on Jan. 15, 2008, in the names of Maurice Despins and David Despins, which is hereby incorporated by reference for all purposes.

TECHNICAL FIELD OF THE INVENTION

The present disclosure is related to the field of hand-operated bar clamps and, in particular, to force multiplying handle mechanisms that multiply the force applied to hand-operated bar clamps.

BACKGROUND OF THE INVENTION

Hand-operated bar clamps are well known. A representative example of a prior art bar clamp is shown in FIG. 1. Prior art bar clamp 10 can comprise bar 12 and housing 14 disposed thereon. Housing 14 can comprise fixed handle 16 and movable handle 18 that can operate as a "pistol grip." Housing 14 can comprise clamp head 24. Fixed clamp head 22 can be disposed on one end of bar 12 such that the clamp heads are facing towards each other. To operate bar clamp 10, a person uses their hand to squeeze handle 18 towards fixed handle 16. In so doing, housing 14 advances along bar 12 such that clamp head 24 approaches clamp head 22 to clamp an object placed therebetween. It is also known that fixed clamp head 22 can be moved to the opposite end of bar 12 such that the clamp heads are facing away from each other (not shown). In this configuration, bar clamp 10 can be used as a "spreader" to force one object away from another. To release bar clamp 10 from applying a clamping or spreading force, release trigger 20 can be operated to release the force applied by bar clamp 10.

Operating bar clamp 10 in the manner described above can require a significant amount of force to be applied by one hand depending on what is being clamped together or forced apart. In some situations, the force required is greater than what can be applied by squeezing with one hand. It is, therefore, desirable to provide a mechanism that can multiply the force that is applied to the fixed and movable handles of a bar clamp.

SUMMARY OF THE INVENTION

A force multiplying handle mechanism for a hand-operated bar clamp is provided. In one embodiment, the mechanism can comprise pivot attachment means disposed on the end of the fixed handle of the bar clamp. A pivoting handle having a pivot plate can be pivotally attached to the pivot attachment means. The pivoting handle and pivot plate can form an L-shaped lever member having at least one pivot attachment point disposed between the ends of the pivot plate. A pin can extend perpendicular from the pivot plate and can be configured to contact the movable handle of the bar clamp. When force is applied to the handle, the L-shaped member can pivot about the pivot attachment point and causes the pin to contact the movable handle and squeeze it towards the fixed handle of the bar clamp. In providing such a mechanism, a force greater than what can be applied by hand can be applied to the bar clamp so it can provide a greater clamping or spreading force.

Broadly stated, a force multiplying handle mechanism for a hand-operated bar clamp having a fixed handle and a movable handle is provided, the mechanism comprising: means for pivotal attachment configured to attach to the end of the fixed handle; a handle having a pivot plate disposed on one end of the handle extending therefrom thereby substantially forming an L-shaped member, the pivot plate pivotally attached to the pivotal attachment means; and a pin extending substantially perpendicularly from the pivot plate, the pin configured to contact the movable handle when the pivotal attachment means is attached to the fixed handle, wherein the pivot plate pivots and the pin squeezes the movable handle towards the fixed handle when force is applied to the handle.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific ways to make and use the invention, and do not delimit the scope of the present invention.

Figure 1:
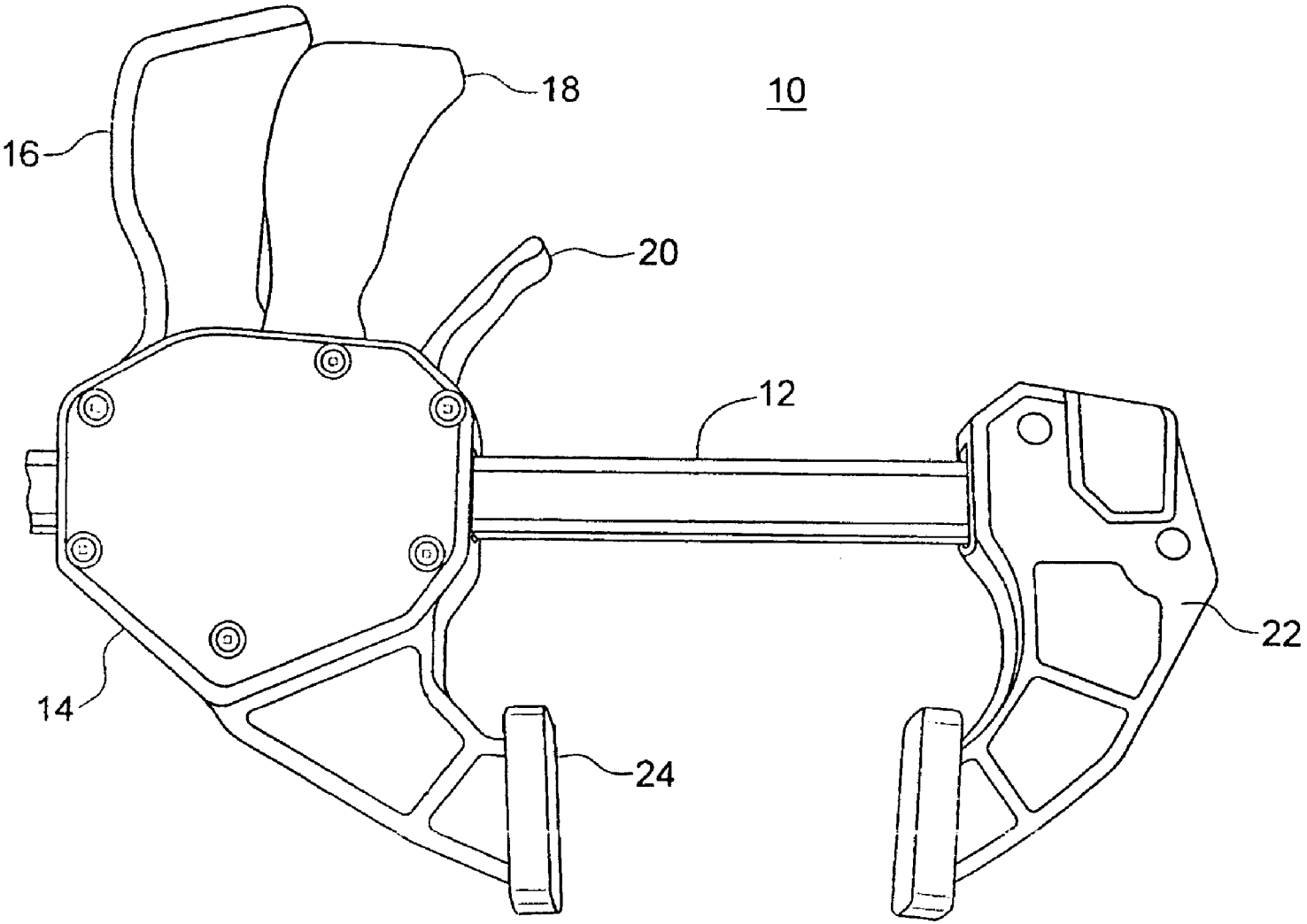
FIG. 1 (PRIOR ART)
FIG. 1 is a side elevation view of a prior art bar clamp.
Figure 2:
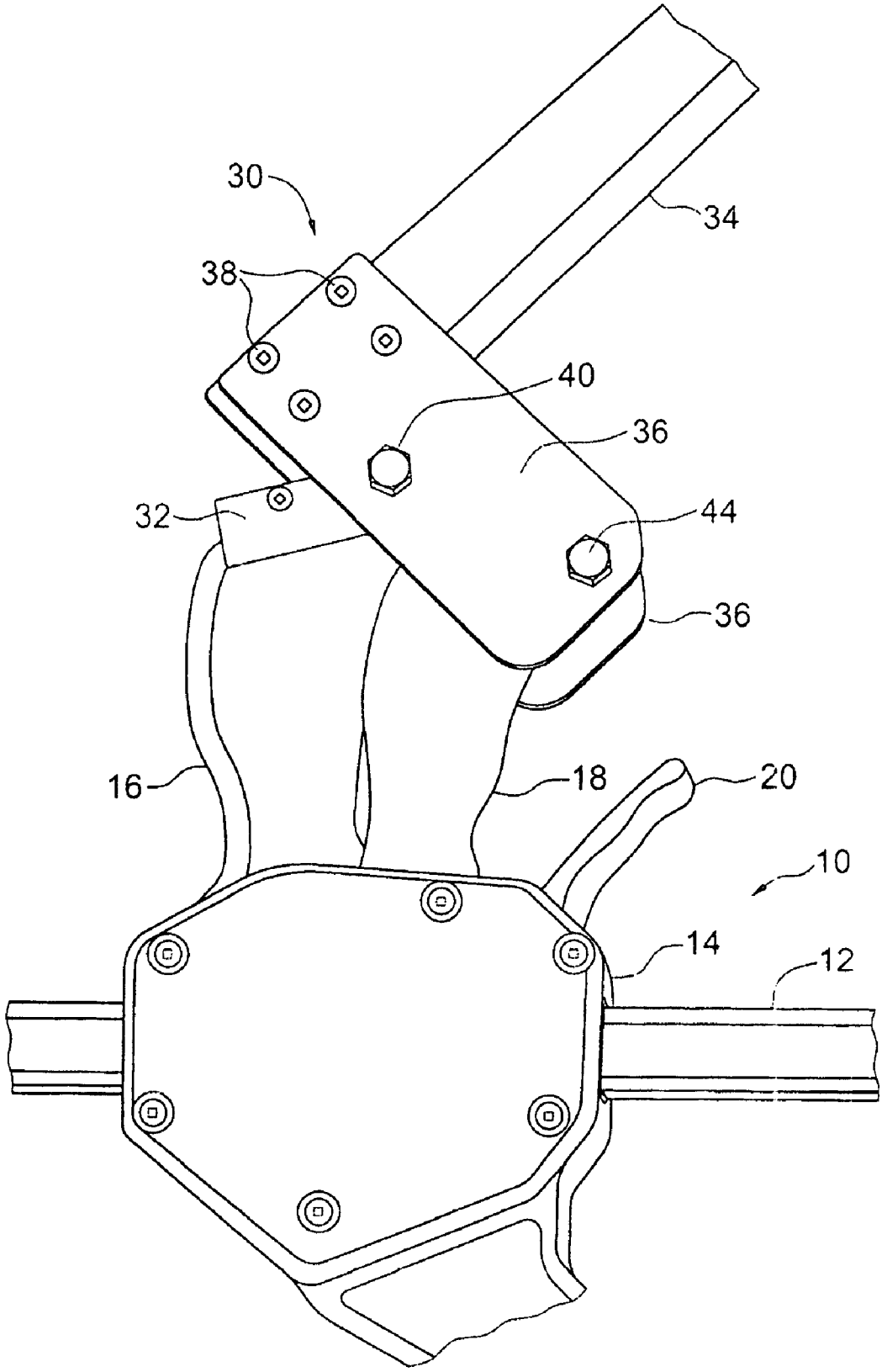
FIG. 2 is a side elevation view of one embodiment of a force multiplying handle mechanism attached to the bar clamp of FIG. 1.
Figure 4:
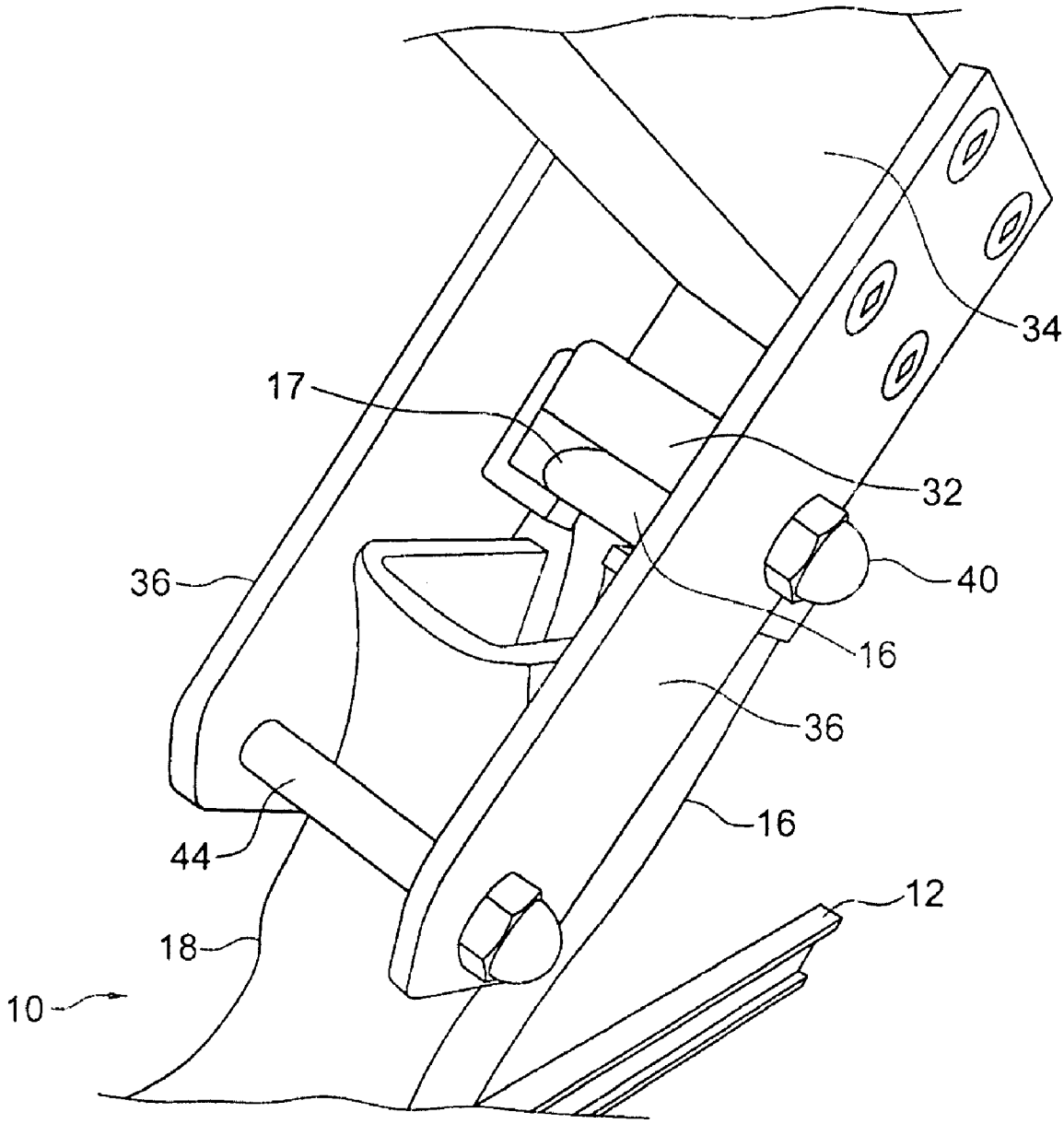
FIG. 4 is a top perspective view of the force applying handle mechanism of FIG. 2 when force is being applied to the handle mechanism.

Referring to FIG. 2, force multiplying handle mechanism 30 is shown attached to bar clamp 10. In one embodiment, pivot attachment means 32 for attaching mechanism 30 to bar clamp 10 can be configured to attach to the end of fixed handle 16. In a further embodiment, pivot attachment means 32 can be any suitable member or bracket that can slide over the end of handle 16 and be attached thereto with fasteners or screws (not shown), or by any other suitable attachment means obvious those skilled in the art. In the illustrated embodiment, pivot attachment means 32 can comprise an extruded metal channel configured to slide onto edges 17 disposed on fixed handle 16 (as shown in FIG. 4). As shown, mechanism 30 can comprise handle 34 having pivot plates 36 attached thereon with fasteners 38. Handle 34 can have any suitable length so as to increase or multiply the force that can normally be applied to bar clamp 10 by hand, the length of which can easily and obviously be selected by those skilled in the art. In a representative embodiment, handle 34 can have a length ranging anywhere from approximately 6 inches to 12 inches or so although lengths longer or shorter than this range can be used as well. Pivot plates 36 can extend from handle 34 to form a substantially L-shaped member that can be pivotally attached to pivot attachment means 32 at one or more pivot points. In the illustrated embodiment, mechanism 30 can comprise a pair of pivot plates 36 that straddle pivot attachment means 32 although it is obvious to those skilled in the art that mechanism 30 can comprise a single pivot plate 36 and still operate in the same manner. Bolt 40 can pass through holes disposed in pivot plates 36 and pivot attachment means 32 whereby mechanism 30 can pivot about the pivot point defined by bolt 40. A pin can extend perpendicularly from pivot plate 36 and can be configured to contact movable handle 18. In the illustrated embodiment, the pin is shown as bolt 44.

Figure 3:
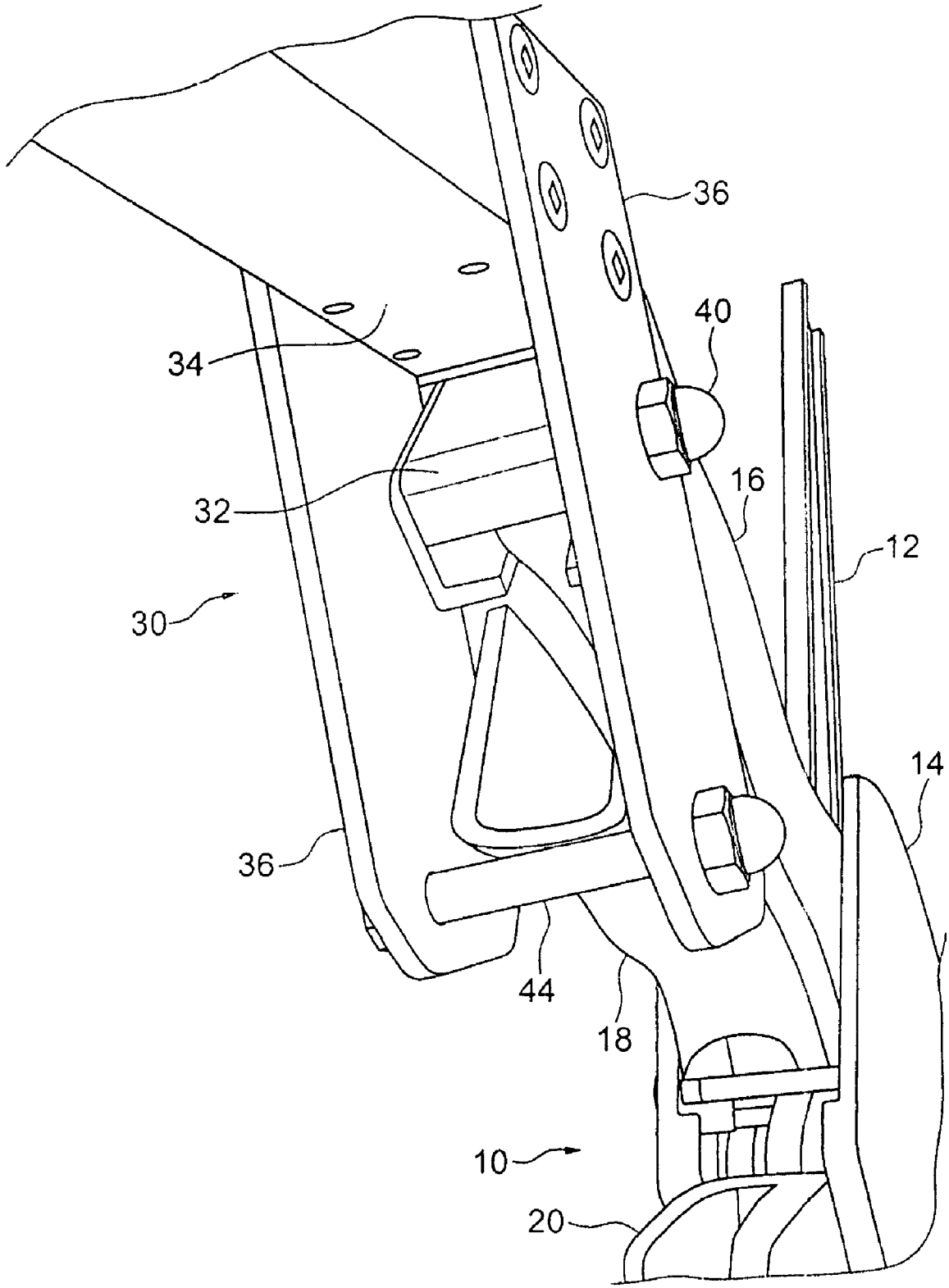
FIG. 3 is a top perspective view of the force applying handle mechanism of FIG. 2 when no force is being applied to the handle mechanism.

Referring to FIG. 3, mechanism 30 is shown before any force is applied to handle 34. In this illustration, bolt 44 is located near the upper end of handle 18. When force is applied to handle 34 to cause mechanism 30 to pivot about bolt 40, as shown in FIG. 4, bolt 44 contacts movable handle 18 and squeezes it towards fixed handle 16. In so doing, bolt 44 moves downwardly along movable handle 18.

Figure 5:
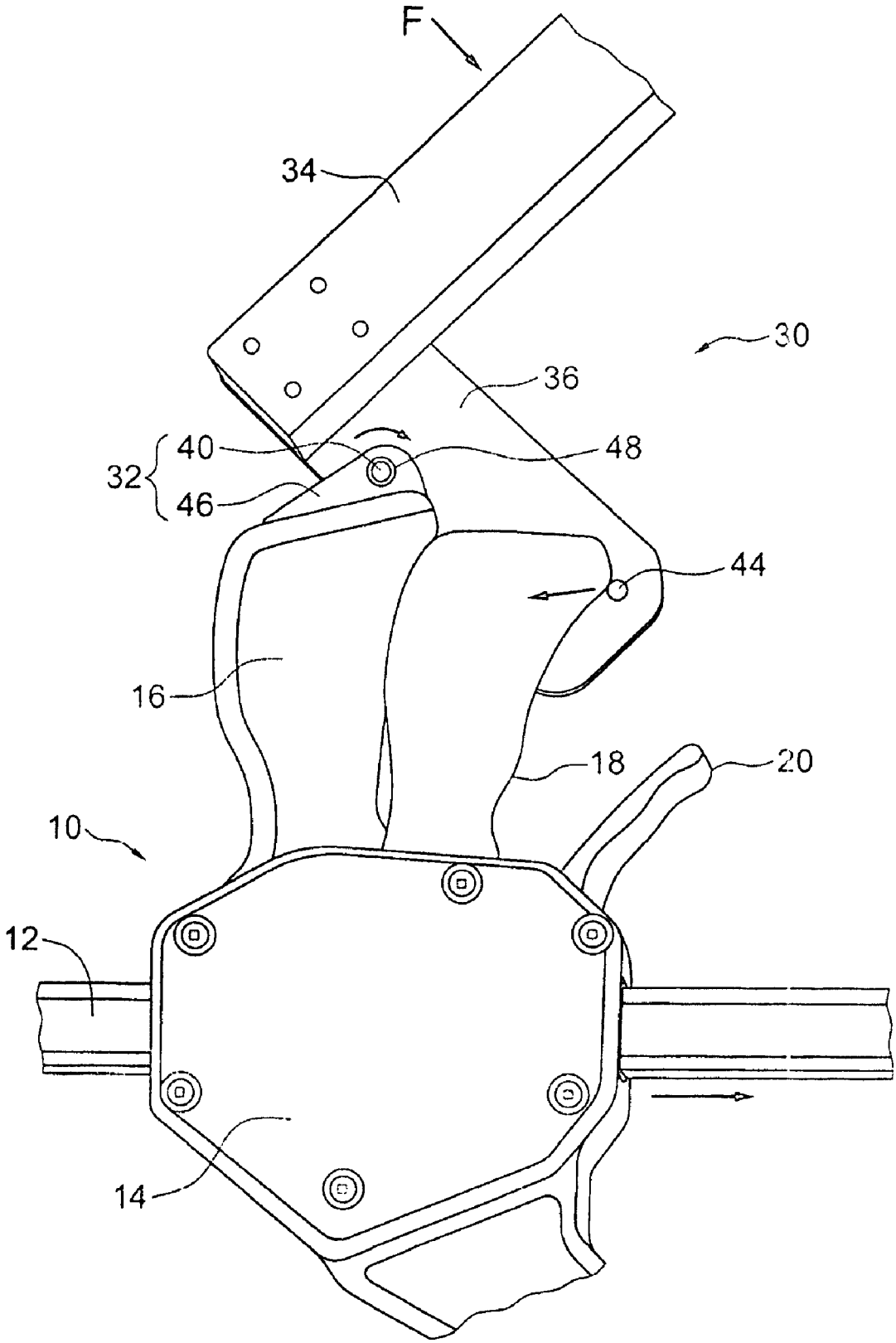
FIG. 5 is a side elevation view of an alternate force multiplying handle mechanism attached to the bar clamp of FIG. 1.

Referring to FIG. 5, an alternate embodiment of mechanism 30 is shown. In this illustration, the top pivot plate 36 has been removed to illustrate the alternate embodiment. In this embodiment, pivot attachment means 32 can comprise pivot flange 46 disposed on the upper end of fixed handle 16. Pivot flange 46 can be a separate member configured to attach to fixed handle 16 or it can be integrally formed on handle 16 when handle 16 is manufactured as obvious to those skilled in the art. Pivot flange 46 can further comprise hole 48 to allow bolt 40 to pass through thereby providing the pivot attachment point for mechanism 30. When force F is applied to handle 34, mechanism 30 can pivot about bolt 40 in a clockwise direction as shown in this illustration. This causes bolt 44 to contact movable handle 18 and squeeze it towards fixed handle 16 thereby causing bar clamp 10 to advance from left to right on bar 12 as shown in this illustration. In one embodiment, mechanism 30 can comprise a single pivot plate 36. In another embodiment, mechanism 30 can comprise a pair of pivot plates 36 that straddle pivot attachment means 32.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. An improved hand-operated bar clamp having a fixed handle and a movable handle, the improvement comprising:

means for pivotal attachment configured to attach to the end of the fixed handle;

a handle having a pivot plate disposed on one end of the handle extending therefrom thereby substantially forming an L-shaped member, the pivot plate pivotally attached to the pivotal attachment means; and a pin extending substantially perpendicularly from the pivot plate, the pin configured to contact the movable handle when the pivotal attachment means is attached to the fixed handle, wherein the pivot plate pivots and the pin squeezes the movable handle towards the fixed handle when force is applied to the handle.

2. The improved bar clamp as set forth in claim 1, wherein the pivotal attachment means further comprises a bracket that can be attached to the end of the fixed handle.

3. The improved bar clamp as set forth in claim 2, wherein the handle further comprises a second pivot plate disposed on one end of the handle extending therefrom thereby substantially forming an L-shaped member, the pair of pivot plates configured to straddle the pivotal attachment means.

4. The improved bar clamp as set forth in claim 2, wherein the bracket further comprises an extruded metal channel configured to slide onto the fixed handle and be fastened thereto with attachment means.

5. The improved bar clamp as set forth in claim 4, wherein the attachment means further comprises screws.

6. The improved bar clamp as set forth in claim 1, wherein the pivotal attachment means further comprises a pivot flange disposed on the end of the fixed handle.

7. The improved bar clamp as set forth in claim 6, wherein the pivot flange further comprises a separate member configured to attach to the fixed handle.

8. The improved bar clamp as set forth in claim 7, wherein the pivot flange further comprises an aperture to allow a bolt to pivotally attach the flange to the pivot plate.

9. The improved bar clamp as set forth in claim 6, wherein the pivot flange is integrally formed on the handle.

10. The improved bar clamp as set forth in claim 9, wherein the pivot flange further comprises an aperture to allow a bolt to pivotally attach the flange to the pivot plate.

11. An apparatus, comprising:

a hand-operated bar clamp, further comprising a fixed handle and a movable handle;

means for pivotal attachment disposed on the end of the fixed handle;

a handle having a pivot plate disposed on one end of the handle extending therefrom thereby substantially forming an L-shaped member, the pivot plate pivotally attached to the pivotal attachment means; and a pin extending substantially perpendicularly from the pivot plate, the pin configured to contact the movable handle when the pivotal attachment means is attached to the fixed handle, wherein the pivot plate pivots and the pin squeezes the movable handle towards the fixed handle when force is applied to the handle.

12. The apparatus as set forth in claim 11, wherein the pivotal attachment means further comprises a bracket that can be attached to the end of the fixed handle.

13. The apparatus as set forth in claim 12, wherein the handle further comprises a second pivot plate disposed on one end of the handle extending therefrom thereby substantially forming an L-shaped member, the pair of pivot plates configured to straddle the pivotal attachment means.

14. The apparatus as set forth in claim 12, wherein the bracket further comprises an extruded metal channel configured to slide onto the fixed handle and be fastened thereto with attachment means.

15. The apparatus as set forth in claim 14, wherein the attachment means further comprises screws.

16. The apparatus as set forth in claim 11, wherein the pivotal attachment means further comprises a pivot flange disposed on the end of the fixed handle.

17. The apparatus as set forth in claim 16, wherein the pivot flange further comprises a separate member configured to attach to the fixed handle.

18. The apparatus as set forth in claim 17, wherein the pivot flange further comprises an aperture to allow a bolt to pivotally attach the flange to the pivot plate.

19. The apparatus as set forth in claim 16, wherein the pivot flange is integrally formed on the handle.

20. The apparatus as set forth in claim 19, wherein the pivot flange further comprises an aperture to allow a bolt to pivotally attach the flange to the pivot plate.

* * * * *